US012310500B2

(12) United States Patent
Funke et al.

(10) Patent No.: US 12,310,500 B2
(45) Date of Patent: May 27, 2025

(54) FRAME ELEMENT FOR INSTALLATION IN WORK FURNITURE

(71) Applicant: BLANCO GMBH + CO KG, Oberderdingen (DE)

(72) Inventors: Thomas Funke, Eppingen (DE); Tobias Tack, Oberderdingen (DE); Thordt Clausen, Göppingen (DE)

(73) Assignee: BLANCO GMBH + CO KG, Oberderdingen (DE)

( * ) Notice: Subject to any disclaimer, the term of this patent is extended or adjusted under 35 U.S.C. 154(b) by 308 days.

(21) Appl. No.: 17/720,568

(22) Filed: Apr. 14, 2022

(65) Prior Publication Data

US 2022/0330698 A1 Oct. 20, 2022

(30) Foreign Application Priority Data

Apr. 16, 2021 (DE) ..... 10 2021 203 803.4

(51) Int. Cl.
*A47B 96/20* (2006.01)
*A47B 77/08* (2006.01)

(52) U.S. Cl.
CPC ..... *A47B 96/20* (2013.01); *A47B 77/08* (2013.01); *A47B 2096/207* (2013.01)

(58) Field of Classification Search
CPC .... A47B 96/20; A47B 2096/207; A47B 77/08
See application file for complete search history.

(56) References Cited

U.S. PATENT DOCUMENTS

| | | | | |
|---|---|---|---|---|
| 3,841,727 | A | 10/1974 | Peng | |
| 2012/0133253 | A1* | 5/2012 | Bergevin | A47B 47/042 312/204 |
| 2014/0097119 | A1* | 4/2014 | Zabinski | A47B 77/16 206/557 |
| 2017/0127825 | A1 | 5/2017 | Melnick | |

FOREIGN PATENT DOCUMENTS

| | | |
|---|---|---|
| AT | 502 332 | 3/2007 |
| DE | 103 05 311 | 8/2004 |
| DE | 10 2009 060 723 | 7/2010 |
| DE | 20 2013 100939 | 5/2013 |
| DE | 10 2015 226 598 | 8/2017 |
| EP | 2 100 537 | 9/2009 |

* cited by examiner

*Primary Examiner* — Matthew W Ing
(74) *Attorney, Agent, or Firm* — Wenderoth, Lind & Ponack, L.L.P.

(57) ABSTRACT

A furniture system includes a sink, a frame element, a divider, a first module, and a second module. A cross section of the frame element is U-shaped or rectangular such that the frame element includes at least a horizontal extension and a vertical extension. Each of the first module and the second module is arranged along at least one of the horizontal extension or the vertical extension. A dimension of the second module along the at least one of the horizontal extension or the vertical extension is an integral multiple of a dimension of the first module along the at least one of the horizontal extension or the vertical extension. The divider is configured to be detachably secured in the frame element. A dimension of the divider corresponds to the dimension of the first module or the integral multiple of the dimension of the first module.

20 Claims, 6 Drawing Sheets

FRAME ELEMENT FOR INSTALLATION IN WORK FURNITURE

BACKGROUND OF THE INVENTION

1. Field of the Invention

The invention relates to a frame element for installation in a piece of work furniture.

The invention further relates to a frame element system.

The invention further relates to piece of work furniture comprising a frame element system.

2. Description of the Related Art

Although generally applicable to any piece of work furniture, in particular pieces of sanitary furniture, this invention is described with reference to base cabinets for kitchen sinks.

Typically, a sink consisting of washing-up bowl and fitting is installed in a sink unit. In a known manner, the sink unit has a base cabinet, in which various devices are arranged, for instance, a waste separation system for a user of the sink and, if necessary, a water treatment device or the like. Since individual boundary conditions, such as width, depth and height of the work furniture and thus also of the base cabinet, which can also be changed by a user at short notice, if necessary, often have to be taken into account, the individual devices are secured directly to the base cabinet or its movable door or drawer. The individual devices have a wide range of dimensions and are installed on site directly by an installer at a suitable position in the base cabinet. For a high number of devices, this means that they can only be installed at great expense or even not at all due to the lack of available space.

To partially separate at least the piping of the sink from the other equipment to be arranged, it has become known to provide a shelf in the base cabinet for this purpose, which does not extend over the entire depth of the base cabinet.

DE 103 05 311 A1 further discloses a base cabinet that accommodates installations of various types and is intended for housing various equipment and objects. The base cabinet comprises a cabinet body, wherein the cabinet body accommodates an inner housing having a smaller height and/or a smaller depth and/or a smaller width than the interior of the cabinet body, and the installations in the cabinet body are arranged at least partially in the remaining space outside the inner housing. Instead of the inner housing, a partial housing consisting of one or more cover elements or a stand-alone cabinet can also be used. Furthermore, the installation modules can be arranged on an L-shaped mounting frame outside the inner housing.

SUMMARY OF THE INVENTION

Therefore, this invention addresses the problem of providing a frame element, a frame element system and a piece of work furniture, which makes for a simple and quick assembly of equipment while at the same time improving the use of installation space for a variety of possible work furniture or base cabinets.

This invention further addresses the problem of providing an alternative frame element, an alternative frame element system, and an alternative piece of work furniture.

This invention solves the problems mentioned above based on an embodiment which provides a frame element for installation in a piece of work furniture or the like, in particular sanitary furniture, wherein the frame element has an at least U-shaped, in particular rectangular cross section and a defined extension, at least in two dimensions, such that modules can be arranged along at least one of the defined extensions, wherein the plurality of modules have dimensions along the at least one extension which are an integral multiple of the extension of a basic module, and wherein at least one horizontal and/or vertical divider corresponding to the dimensions of the basic module or an integral multiple thereof can be secured, in particular detachably, in the frame element.

This invention further solves the problems mentioned above based on an embodiment providing a frame element system comprising

- a frame element according to any one of first to tenth aspects, and
- at least one additional of the components listed below:
  - a divider for dividing the frame element in horizontal and/or vertical direction that can be secured in or on the frame element, and/or
  - an attachment element which can be secured to the frame element by means of attaching, wherein the element in particular is L-shaped having a U-shaped attachment area.

This invention further solves the above-mentioned problems based on an embodiment providing a piece work furniture having a frame element system according to an eleventh or twelfth aspect, in that the frame element is secured to the work furniture, wherein the work furniture has a door or drawer covering the frame element, wherein the door or drawer has a vertical and/or horizontal subdivision according to a grid, wherein integer multiples of a dimension of the base module in at least one spatial direction match the grid of the work furniture.

This invention further solves the problems mentioned above based on an embodiment providing a work furniture system comprising a piece of work furniture according to a thirteenth aspect and at least one module having a dimension along at least one extension direction that is an integer multiple of the extension of the base module.

One of the advantages achieved in this way is that the installation space can be utilized optimally and can be flexibly subdivided, in particular adapted to customer requirements while still on site. Another advantage is that the frame element can be manufactured easily and cost-effectively and can be flexibly equipped with a wide variety of modules. Another advantage is that the frame element permits, for instance, modules designed for installation in a base cabinet of smaller width to be also used in a base cabinet of greater width due to the frame element.

The term "module" as used in particular in the description, preferably in the claims, denotes a device, system, component or unit that provides a technical effect and/or assistance to a user with respect to the use, application or use of the piece of work furniture. The term "module" includes, for instance, a filter device, a waste container or the like for a piece of work furniture in the form of a kitchen base cabinet. The term "module" does not comprise, in particular, structural elements such as a frame, side wall, rear wall or the like, even if these are arranged in an exchangeable, detachable or similar manner.

The term "plumbing" shall be understood in the broadest sense and refers, in particular in the claims, preferably in the description, generally to the kitchen area, the bathroom or laundry area, and the heating area.

Further features, advantages and further embodiments of the invention are described below or are disclosed in that way.

According to a preferred embodiment of the invention, the frame element is bipartite in design, wherein the two frame parts have corresponding projections and recesses which engage with one another, in particular if both frame parts are formed identically. The advantages thereof are space-saving transport and cost-effective production.

According to a further preferred embodiment of the invention, the projections are secured to one another in the recesses, in particular by inserting, screwing and/or clipping. The advantage thereof is a simple alignment of the two parts of the frame element for defining them, for instance still on site at a customer's. Generally, upstands, edges and/or rim projections or the like may also be disposed on the projections and/or recesses to secure the projections in the recesses.

According to a further preferred embodiment of the invention, the frame element is integrally designed, in particular wherein at least one lateral recess is arranged on the different sides. The advantage thereof is, on the one hand, that material and thus weight and costs are saved. In addition, module assembly is facilitated by lateral accessibility, as is handling during assembly.

According to a further preferred embodiment of the invention, securing elements, in particular in the form of recesses, are arranged on the inside of the frame element for securing at least one horizontal and/or vertical divider, in particular if the latter has projections corresponding to the recesses. The advantage thereof is a simple and quick definition of dividers, wherein these provide the frame element simultaneously with an increased rigidity.

According to a further preferred embodiment of the invention, the at least one horizontal and/or vertical divider is designed to be inserted or pushed into the frame element, in particular wherein the dimension of the at least one horizontal and/or vertical divider is smaller than the distance between the respective adjacent sides of the frame element and wherein the dimension of the at least one horizontal and/or vertical divider and the projections is larger than the distance between the respective adjacent sides of the frame element. This makes for a particularly simple and fast assembly of dividers.

According to a further preferred embodiment of the invention, at least one divider can be arranged on the outside of the frame element. The advantage thereof is greater flexibility in adapting the frame element to different needs.

According to a further preferred embodiment of the invention, holes are formed on the frame element, corresponding to one or more drilling grids. The advantage thereof is that assembly, in particular of modules on the frame element on site at a customer's, is considerably simplified and can be performed more quickly.

According to a further preferred embodiment of the invention, the frame element is made of wood, metal and/or plastic. The advantage thereof is high flexibility in the selection of materials, which makes for a flexible adaptation to customer requirements or to the stability of the frame element.

According to a further preferred embodiment of the invention, the frame element has at least two different zones, wherein a different basic module is assigned to every zone. The advantage thereof is a more flexible arrangement of modules based on different basic bodies.

According to a preferred embodiment of the frame element system, the at least one attachment element can be secured to the frame element without tools, in particular attached in such a way that it can be detachably secured to the frame element by means of clamping, in particular by means of the U-shaped attachment area. This makes for particularly simple, flexible and fast expandability or adaptability on site at the customer's premises during assembly of the frame element. In addition, the installation of the frame element is simplified.

According to a preferred embodiment of the work furniture system, the at least one module is designed as

- an electronic module,
- a storage module, in particular in the form of a waste container,
- a filter module to provide filtered water,
- a carbonation module to provide carbonated water,
- a warming and/or heating module for the provision of hot water,
- a cooling water module to provide chilled water,
- a cooling module for cooling at least part of the storage module,
- a module for grinding and shredding, which is connected to the drain module and/or the storage module,
- an ionization module to ionize water,
- an enrichment module for enriching the water with at least one substance, in particular mineral substance, flavoring, coloring or the like,
- an add-on module for the addition of concentrates, in particular fruit juice concentrates or the like,
- a light module for illuminating at least one of the other modules, and/or
- at least one organization module for arranging items in an orderly manner, for instance, dishwashing detergents, sponges or the like.

One of the advantages achieved in this way is a high degree of flexibility in the arrangement of possible modules.

Further important features and advantages of the invention are described in more detail in the dependent claims, in the drawings, and in the accompanying figure description based on the drawings.

It goes without saying that the features mentioned above and those to be explained below can be used not only in the combination indicated in each case, but also in other combinations or on their own, without departing from the scope of this invention.

Preferred embodiments and embodiments of this invention are shown in the drawings and will be explained in more detail in the following description, wherein identical reference signs refer to identical or similar or functionally identical components or elements.

DETAILED DESCRIPTION OF THE INVENTION

Figure 1:
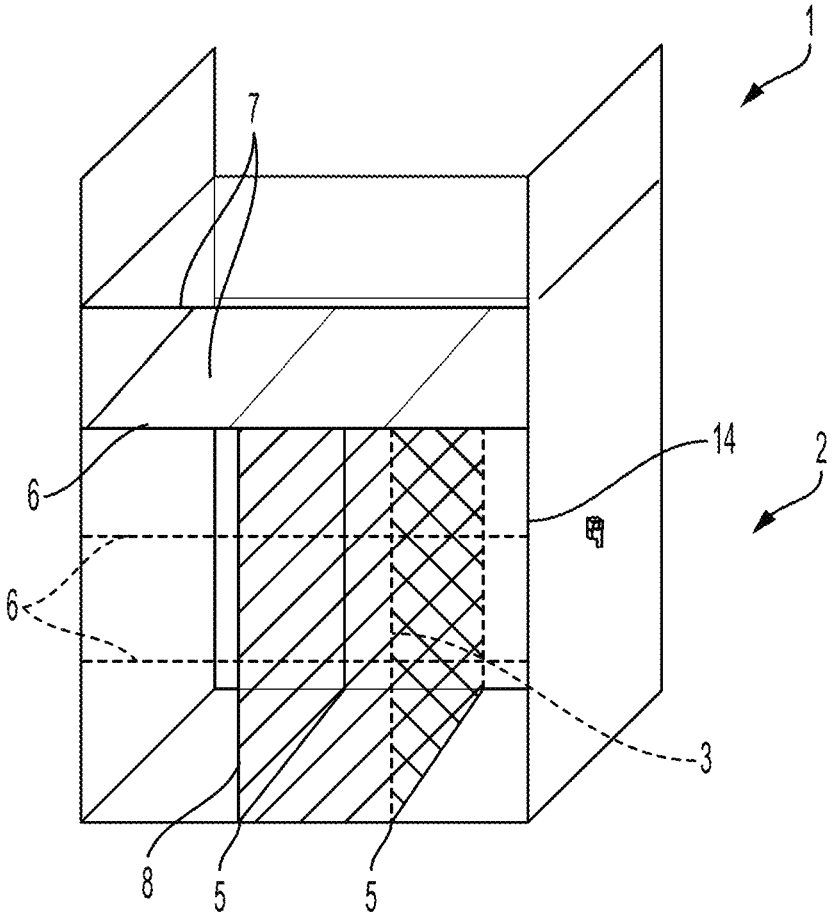
FIG. 1 shows a frame element according to an embodiment of this invention.

FIG. 1 shows a frame element according to an embodiment of this invention.

FIG. 1 shows a frame element 1 in U-shape 2, which frame element is open at the top. The frame element 1 has a secured base frame for inside widths of base cabinets of 60 cm, 80 cm or 90 cm. For bracing purposes, a horizontal divider 7 is welded in parallel to the floor between the two legs of the U-shape 2. Furthermore, horizontal partition elements 7 and vertical partition elements 8 are arranged in a horizontal grid 5 of 184 mm. Such a basic module 3 based on grid 5 is shown hatched. One module can then match to two basic modules 3 arranged adjacently, for instance.

Securing elements (not shown here) are arranged in the corresponding grid 5 to be able to secure the dividers 7, 8, in particular in a detachable manner. Usually, one end of the frame element 1 is covered by a door or drawer, for instance a kitchen door or drawer. For instance, this kitchen door or drawer has a vertical subdivision 14 matching the inner vertical grid 6 of the frame element 1.

Figure 2:
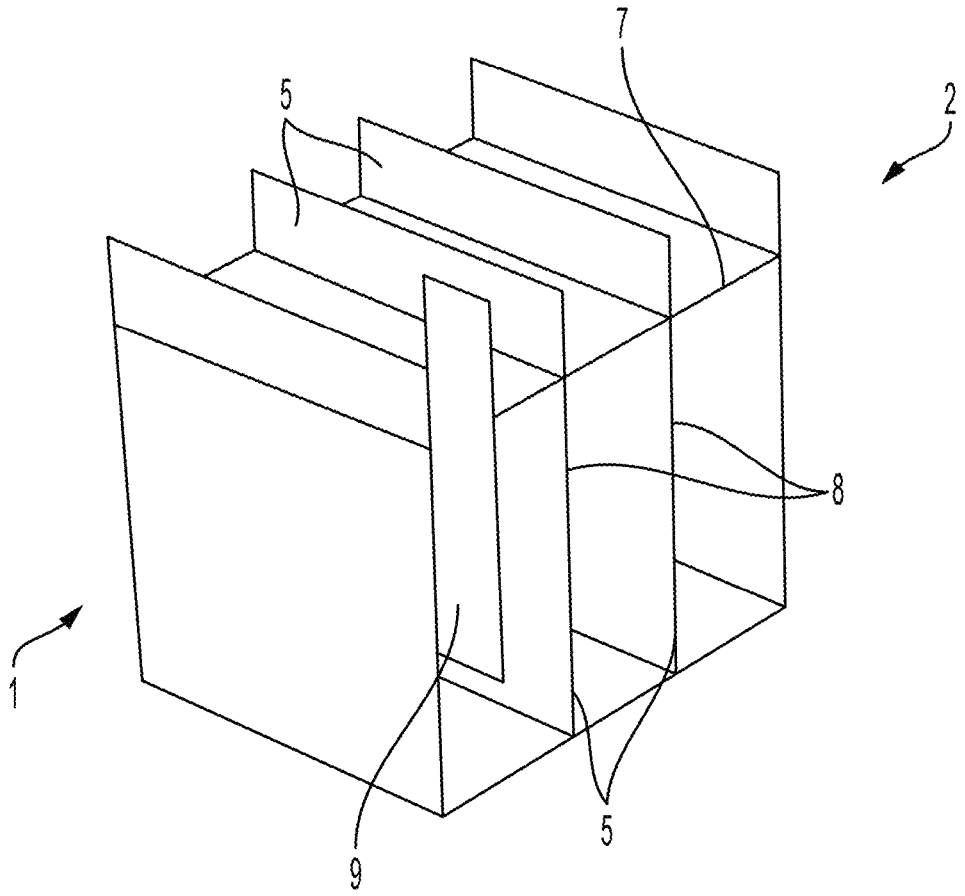
FIG. 2 shows a frame element according to an embodiment of this invention.

FIG. 2 shows a frame element according to an embodiment of this invention.

FIG. 2 is a frame element 1 having a cuboid shape 2. The frame element 1 further has a solid base frame for inside widths of base cabinets of 60 cm, 80 cm or 90 cm. A horizontal divider 7 is welded between the two legs of the original U-shape, forming a cuboid frame element 1 in parallel to the floor. Furthermore, two vertical dividers 8 are arranged in a horizontal grid 5 of 184 mm. Further vertical dividers 8 projecting upwards are arranged at the upper end of the frame element 1, which can be secured independently from the dividers 8 inside the frame element 1, in particular detachably. On the right side of FIG. 2, an attachment element 9 is detachably arranged at the left end of the frame element 1 in parallel to the wall of frame element forming a frictional engagement, which attachment element extends the wall or side of the frame element 1 accordingly—in FIG. 2 from left to right, extending diagonally downwards. Likewise, it extends upward beyond the vertical dividers 8 in FIG. 2.

Further horizontal dividers 7 and further vertical dividers 8 can be arranged according to the relevant grid.

Figure 3:
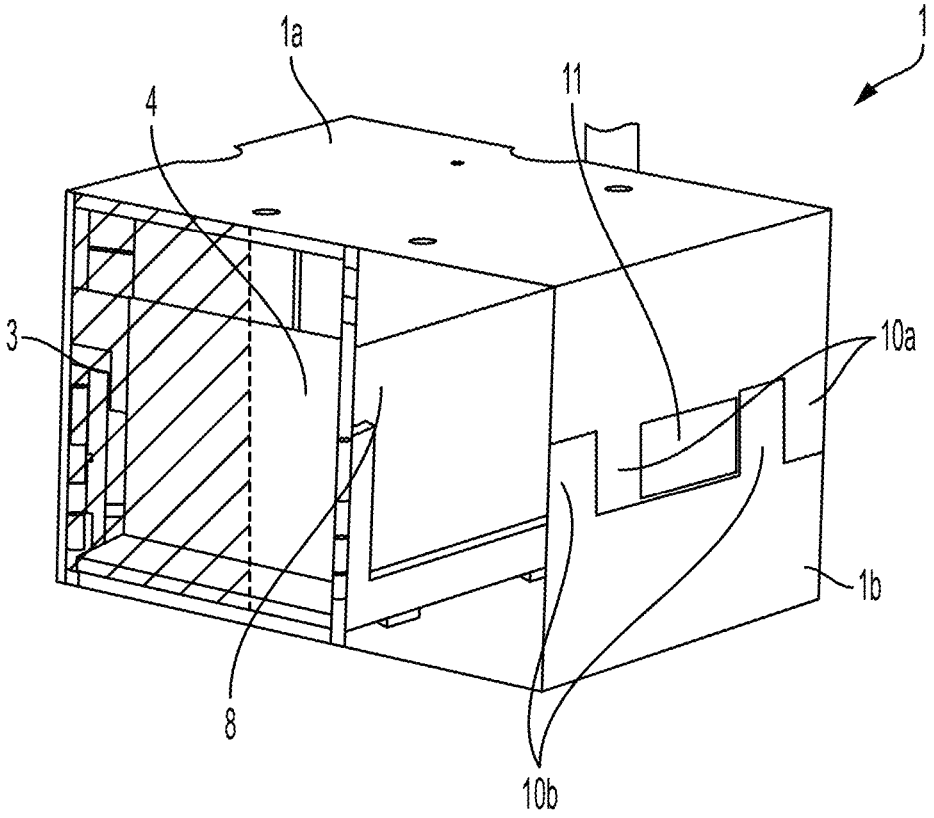
FIG. 3 shows a frame element according to an embodiment of this invention.
Figure 4:
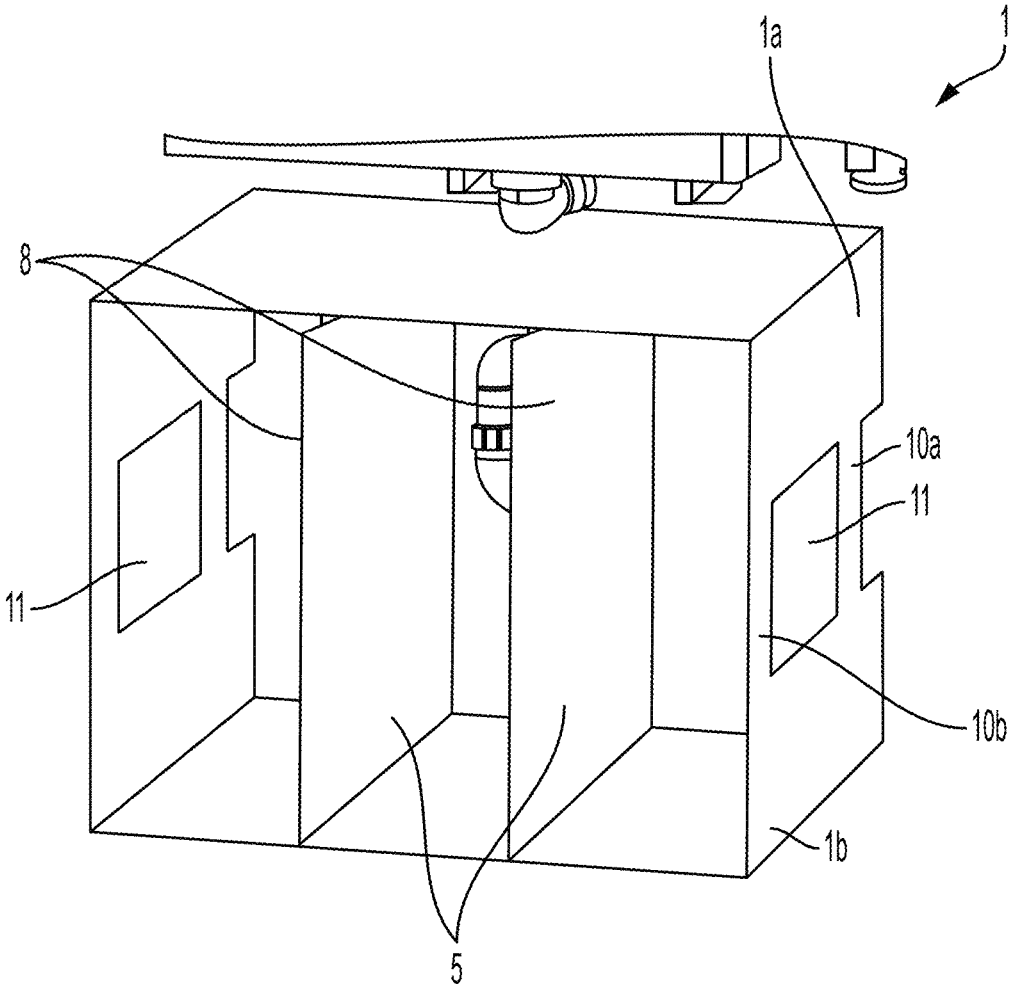
FIG. 4 shows a frame element according to an embodiment of this invention.

FIGS. 3 and 4 show one frame element each according to an embodiment of this invention.

FIGS. 3 and 4 each show a frame element 1 that is bipartite in design. Both parts 1*a*, 1*b* have the same structure. Essentially, the two parts 1*a*, 1*b* are U-shaped, wherein two projections 10*a*, 10*b* are arranged on each side of the legs of the "U".

In FIG. 3, the projections 10*a*, 10*b* of the parts 1*a*, 1*b* for forming the frame element 1 are arranged such that they are each adjacent to the projections 10*a*, 10*b* of the respective other parts 1*a*, 1*b*. For this purpose, the two parts 1*a*, 1*b* are thus placed on top of each other, but rotated by 180 degrees about the vertical axis as shown in FIG. 1. This can provide a first height, i.e. the vertical extension in FIG. 3, for instance 365 mm. A recess 11 is formed by the projections 10*a*, 10*b*. FIG. 3 also shows a module 4 twice the size of a base module 3 (shown hatched).

In FIG. 4, the two parts 1*a*, 1*b* and their projections 10*a*, 10*b* are now superposed, i.e. a greater height, in this case 440 mm, of the frame is achieved, and at the same time the recess 11 is larger. Matching vertical partitions 8 can be used to perform a horizontal subdivision based on a grid in both embodiments.

Figure 5:
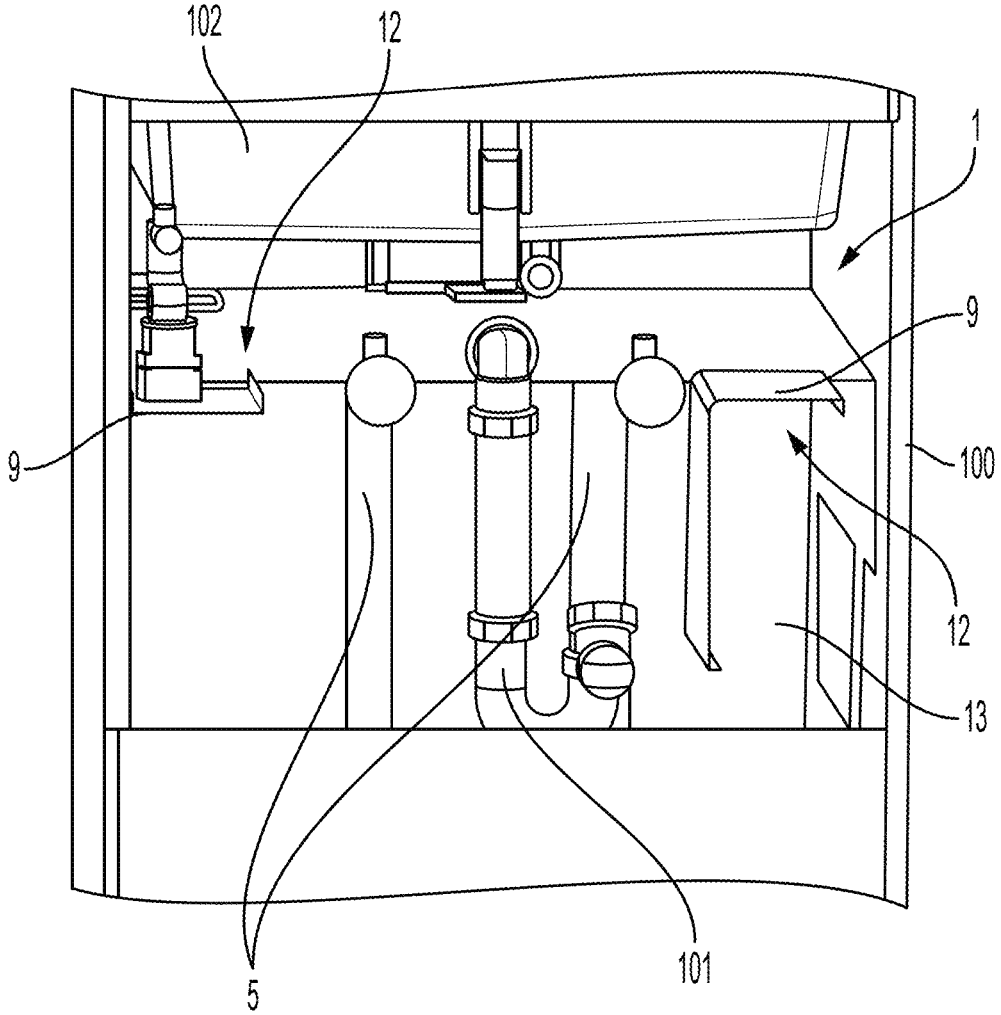
FIG. 5 shows a frame element according to an embodiment of this invention.

FIG. 5 shows a frame element according to an embodiment of this invention.

FIG. 5 shows mainly a frame element 1 according to one of FIGS. 1 to 4. The frame element 1 is now shown installed in a piece of work furniture 100. In FIG. 5 above, a sink 102 is arranged in the piece of work furniture 100 including corresponding piping 101 below the sink 102 in the area of the frame element 1. An attachment element 9 is shown on the frame element 1—on the left side of FIG. 5 from the rear, on the right side of FIG. 5 from the front. The attachment element 9 has an essentially L-shaped area 13 in cross-section, wherein a U-shaped attachment area 12 rotated by 90 degrees adjoins the shorter side of the "L". This attachment area 12 of the attachment element 9 grips around the inside and outside of the frame element 1 and ensures a friction connection between the frame element 1 and the attachment element 9. On the longer side of the "L", for instance, retaining clips for pipes or the like can now be arranged. The detachable connection between frame element 1 and attachment element 9 makes for a quick and easy adaptation to local conditions.

In addition to the L-shape of the attachment element 9 described, it can also be Z-shaped, U-shaped or T-shaped in cross-section, for instance. It is also conceivable that it may, for instance, have a partially elliptical or circular shape in cross-section.

FIG. 6 shows steps of a method for defining a vertical divider in a frame element according to an embodiment of this invention.

Figure 6A:
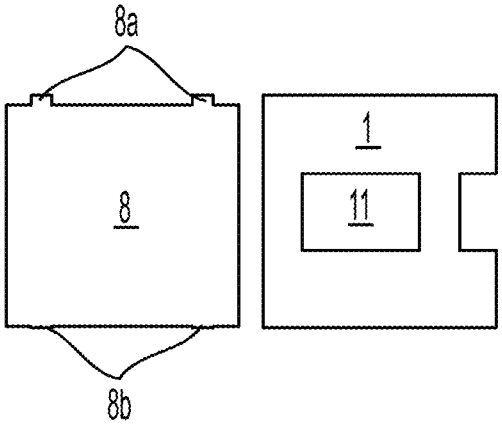
FIG. 6 shows steps of a method for defining a vertical partition element in a frame element according to an embodiment of this invention.

A vertical divider 8 is shown In FIG. 6*a* on the left. The divider 8 has shorter snap lugs 8*b* on its underside and longer snap lugs 8*a* on its top side. The vertical extent of the divider 8 without snap lugs 8*a*, 8*b*—i.e. in the drawing plane in FIG. 6—is smaller than that of the side of the frame element 1 shown on the right side of FIG. 6*a*. The frame element 1 has matching recesses 1*c* (see FIGS. 6*b* to *d*) on the upper and lower inner sides of the frame element 1 for securing the vertical dividers 8. The frame element 1 is designed with the lateral recess 11 as shown in FIG. 4.

Figure 6C:
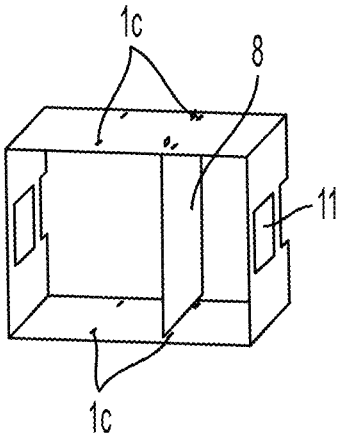
Figure 6B:
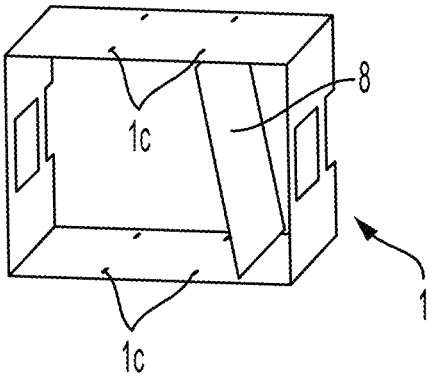
Figure 6D:
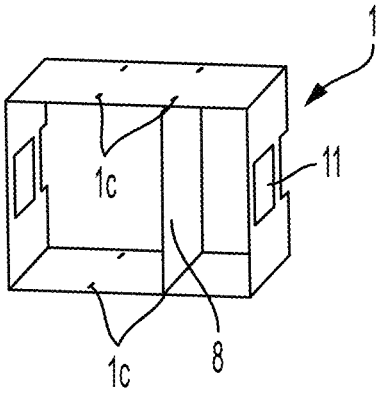

To secure the divider 8 in the frame element 1, the vertical divider 8 is first inserted into the interior of the frame element 1 at an angle with respect to the vertical walls of the frame element 1 (FIG. 6*b*). There, the upper snap lugs 8*a* are then inserted as far as possible into the recesses 1*c* provided for this purpose (FIG. 6*c*). As a result, the divider 8 does not rest on the underside of the frame element 1 and can be pivoted in the horizontal direction such that the lower snap lugs 8*b* can be pivoted over the recesses 1*c* on the underside of the frame element 1. The lower snap lugs 8*b* of the divider 8 can then be lowered into the recesses 1*c*, wherein the upper snap lugs 8*a* remain arranged in the recesses 1*c* (FIG. 6*d*).

One or more of the modules listed below can be arranged in the frame element 1:

- at least one electronic module,
- at least one storage module, in particular in the form of a waste container,
- a filter module to provide filtered water,
- a carbonation module to provide carbonated water,
- a warming and/or heating module for the provision of hot water,
- a cooling water module to provide chilled water,
- a cooling module for cooling at least part of the storage module,
- a module for grinding and shredding, which is connected to the drain module and/or the storage module,
- an ionization module to ionize water, an enrichment module for enriching the water with at least one substance, in particular mineral substance, flavoring, coloring or the like, an add-on module for the addition of concentrates, in particular fruit juice concentrates or the like, a light module for illuminating at least one of the other modules, and/or at least one organization module for arranging items in an orderly manner, for instance, dishwashing detergents, sponges or the like.

Here, one or more modules can be part of other modules. For instance, the carbonation module, the add-on module, and/or the filter module may be part of the water treatment module. The advantage thereof is that it provides a high degree of flexibility in the selection of modules.

In this case, the modules can be secured to the frame element 1 and/or to an adjacent module and/or to a divider, in particular in a detachable manner. Quick-clamping and/or clamping devices can be provided for this purpose, for instance.

Different basic grids may also be provided in different zones in the embodiments described above. For instance, provision can be made for a first function module having a width of 200 mm, for instance, to be already arranged in the cuboid or U-shaped frame element. The remaining installation space, which forms the second zone, can then be provided with modules according to a second basic grid, for instance having a basic width of 184 mm. The 184 mm size forms the second basic grid to make optimum use of different frame element and thus cabinet widths. To provide any height compensation between modules in the second basic grid 184 mm and, for instance, the water treatment module, a third zone having a third grid, an intermediate grid of 75 mm height (184 mm×n width) can be provided. This third basic grid provides an intermediate level of uniform height, on which further modules of the same basic width dimension (184 mm×n) with a height of 100 mm can be positioned. In addition, a further fourth zone is created which, depending on the installation situation, can either be installed with a less deep functional module, for instance a storage surface. For instance, if no sink is installed in the base cabinet, the maximum depth of the base cabinet can also be used for this level. In the event that no sink is installed, functional modules can be installed using the full height of the upper two levels.

This is explained below for a sink base cabinet with frame element, by way of example. The frame element there has the dimensions 60 cm×78 cm×56 cm (W×H×D) and, when viewed from the front, is provided at the bottom right end of the frame element with a water treatment module having a width of 200 mm. Two installation spaces having the dimensions 184 mm×365 mm×500 mm (W×H×D) are formed for this purpose. Functional modules, for instance a waste separation system and an organization system, are then arranged in these installation spaces. Owing to the basic grid, the arrangement of all functional modules including the water treatment module is flexible and can thus be arranged in different ways. This ensures optimum utilization of the available installation space. The flexibility of the arrangement renders reacting to local conditions in the base cabinet, for instance with different positions of water corner valves, possible. In addition, the consistent arrangement of the modules, conveys a high value to a user.

In summary, at least one embodiment of this invention provides at least one of the following advantages and/or provides at least one of the following features:

Flexible adaptation to different pieces of kitchen furniture.

simple, inexpensive manufacture.

Easy and quick assembly of frame element and modules.

Optimized installation space for modules.

Reliable securing of the modules in the frame element.

Reliable securing of the frame element in a piece of working furniture.

Although this invention has been described with reference to preferred exemplary embodiments, it is not limited thereto and can be modified in a variety of ways.

LIST OF REFERENCE NUMERALS

1 Frame element
1*a*, 1*b* Part of the frame element
1*c* Recess
2 Shape frame element
3 Basic module
4 Module
5 Horizontal grid
6 Vertical grid
7 Horizontal divider
8 Vertical divider
8*a*, 8*b* Upper, lower projection/snap lugs
9 Attachment element
10*a* Projection first part
10*b* Projection first part
11 Recess
12 U-shaped area attachment element
13 L-shaped area attachment element
14 Separation of outer door or drawer
100 Work furniture
101 Piping
102 Sink

The invention claimed is:

1. A furniture system comprising:

a sink;

a frame element;

a divider;

a first module; and a second module, wherein:

a cross section of the frame element is U-shaped or rectangular such that the frame element includes at least a horizontal extension and a vertical extension;

each of the first module and the second module is arranged along at least one of the horizontal extension or the vertical extension;

a dimension of the second module along the at least one of the horizontal extension or the vertical extension is an integral multiple of a dimension of the first module along the at least one of the horizontal extension or the vertical extension;

the divider is configured to be detachably secured to the frame element; and a dimension of the divider corresponds to the dimension of the first module or the integral multiple of the dimension of the first module.

2. The furniture system of claim 1, wherein the frame element is integrally formed.

3. The furniture system of claim 1, further comprising a securing element on an inside of the frame element for securing the divider.

4. The furniture system of claim 1, wherein a dimension of the divider is smaller than a distance between respective adjacent sides of the frame element.

5. The furniture system of claim 1, wherein the divider is configured to be detachably secured to an outside of the frame element.

6. The furniture system of claim 1, further comprising drilled holes defined on the frame element so as to match a drilling grid.

7. The furniture system of claim 1, wherein the frame element is made of wood, metal or plastic.

8. The furniture system of claim 1, wherein:

the frame element includes two different zones; and the furniture system comprises two of the first modules assigned to the two different zones, respectively.

9. The furniture system of claim 1, further comprising an L-shaped attachment element which is configured to be attached to the frame element, and has a U-shaped attachment area.

10. The furniture system of claim 9, wherein the L-shaped attachment element is configured to be secured to the frame element without a tool.

11. The furniture system of claim 1, further comprising a door or a drawer covering the frame element, wherein:

the door or the drawer has a vertical or horizontal subdivision according to a grid; and the integral multiple of the dimension of the first module along the at least one of the horizontal extension or the vertical extension matches the grid.

12. The furniture system of claim 1, wherein the second module is:

an electronic module;

a storage module;

a filter module configured to provide filtered water;

a carbonation module configured to provide carbonated water;

a warming or heating module configured to provide hot water;

a cooling water module configured to provide chilled water;

a cooling module configured to cool at least part of the storage module;

a grinding and shredding module which is connected to the storage module or a drain module;

an ionization module configured to provide ionized water;

an enrichment module configured to provide enriched water with at least one substance;

a concentrate addition module configured to add a concentrate;

a light module; or an organization module.

13. The furniture system of claim 9, wherein the L-shaped attachment element is configured to be secured to the frame element by clamping.

14. A frame element comprising:

a first frame part; and a second frame part, wherein:

a cross section of the frame element is U-shaped or rectangular;

the first frame part is identical to the second frame part;

each of the first frame part and the second frame part includes a first projection, a second projection and a recess defined between the first projection and the second projection;

the first projection of the first frame part is configured to engage with the recess of the second frame part;

the first projection of the second frame part is configured to engage with the recess of the first frame part;

the second projection of the first frame part is configured to engage with the first projection of the second frame part; and the second projection of the second frame part is configured to engage with the first projection of the first frame part.

15. The frame element of claim 14, wherein:

the second projection of the first frame part is secured to the first projection of the second frame part by inserting, screwing or clipping; and the second projection of the second frame part is secured to the first projection of the first frame part by inserting, screwing or clipping.

16. The frame element of claim 14, wherein the frame element is integrally formed.

17. The frame element of claim 14, further comprising a securing element on an inside of the frame element for securing a divider.

18. The frame element of claim 14, further comprising drilled holes defined on the frame element so as to match a drilling grid.

19. The frame element of claim 14, wherein the frame element is made of wood, metal or plastic.

20. The frame element of claim 14, wherein the frame element includes two different zones for assignment of two basic modules, respectively.

* * * * *